United States Patent [19]

Ohno et al.

[11] Patent Number: 4,552,312

[45] Date of Patent: Nov. 12, 1985

[54] FUEL INJECTION VALVE

[75] Inventors: Yasuo Ohno; Tadashi Seino; Yukio Ueno; Kenji Kariyama; Shinji Utsugi; Shigeo Okada, all of Iwate, Japan

[73] Assignee: Tohoku Mikuni Kogyo Kabushiki Kaisha, Japan

[21] Appl. No.: 569,167

[22] Filed: Jan. 9, 1984

[30] Foreign Application Priority Data

Jan. 14, 1983 [JP] Japan ..... 58-3325
Feb. 28, 1983 [JP] Japan ..... 58-27012[U]

[51] Int. Cl.[4] ..... B05B 1/30
[52] U.S. Cl. ..... 239/585
[58] Field of Search ..... 239/585; 251/137, 141

[56] References Cited

U.S. PATENT DOCUMENTS 4,057,190 11/1977 Kiwior et al. ..... 239/585

FOREIGN PATENT DOCUMENTS 2755400 6/1979 Fed. Rep. of Germany ..... 239/313

*Primary Examiner*—Andres Kashnikow
*Assistant Examiner*—Scott D. Malpede
*Attorney, Agent, or Firm*—Andrus, Sceales, Starke & Sawall

[57] ABSTRACT

A fuel injection valve has a collar-shaped stopper at the front of a plunger for restricting the plunger stroke between the stopper and the end of a guide pipe. The divergent conical surface or spherical surface is formed at the end of the guide pipe, a spherical surface which makes contact with the conical surface is formed at the opposite side of the stopper of the plunger to the ball, an automatic centering operation is performed at the stroke end of the plunger, thereby preventing the irregular wear of the ball valve and the seat surface to stabilize the performance for a long period of time.

9 Claims, 4 Drawing Figures

FUEL INJECTION VALVE

BACKGROUND OF THE INVENTION

The present invention relates to a fuel injection valve and, more particularly, to an electromagnetic fuel injection valve which is adapted to stably maintain performance for a long period of time.

Conventional fuel injection valves, as disclosed in A. M. Kiwior U.S. Pat. No. 4,057,190, are formed with a core and a plunger disposed in a body, a fuel passage communicated with a hollow valve chamber, a ball valve secured to the end of the plunger and associated separably with a seat member, and a solenoid coil. When the solenoid coil is energized, the ball valve is opened to eject fuel. Even if a valve shaft is coincident to the axial core of a seat surface as mounted initially in an internal combustion engine, the axial core is slightly displaced during use, irregularly worn, and a fuel leakage phenomenon occurs. When the plunger which reciprocates does not always maintain magnetic flux density in the section constant when the solenoid is energized to flow magnetic flux therethrough. Accordingly, the plunger which reciprocates by the energization of the solenoid cannot accurately move on the axial center, and this causes the irregular wear on the seat surface to be increased, and the stable operation to be lost. Further, since the plunger is restricted in its stroke at the upstream side of the fuel passage which is largely isolated from the seat surface, the plunger is affected by the influence of the deformation by the temperature when an internal combustion engine is operated, and the stroke of the plunger increases in its error due to the superposition of the inclination or displacement of the plunger in the guide pipe due to the presence of a clearance between the plunger and the guide pipe and the above-described thermal deformation of the plunger.

SUMMARY OF THE INVENTION

The present invention overcomes the problems encountered in conventional electronically and electromagnetically operated fuel injection valves and thus provides a fuel injection valve which satisfies the requirements of an SPI fuel injection system.

It is a primary object of the invention to provide a fuel injection valve which has stable performance for a long period of time.

It is another object of the invention to provide a fuel injection valve which can achieve an automatic centering operation in the reciprocation of a plunger, thereby eliminating the irregular wear of a valve body.

It is a further object of the invention to provide a fuel injection valve which is capable of suppressing the variation in the flow rate of fuel due to the temperature of the fuel.

The fuel injection valve of the present invention comprises a collar-shaped stopper formed at the front of a plunger for restricting the stroke of the plunger between the stopper and the end of a guide pipe. In this structure, a conical or spherical surface formed at the end of the guide pipe is contacted with the spherical surface formed at the collar-shaped stopper at the opposite side to a ball, thereby performing an automatic centering operation at the end of the stroke of the plunger. Further, in the present invention, the opposite side of the stopper to the ball is communicated with a fuel passage in the plunger, thereby stabilizing the performance for a long period of time by preventing the difficulty in the reciprocating movements of the plunger in the guide pipe. The reason why the stopper is provided at the ball valve side of the plunger is because the stroke of the plunger is restricted at the position in the vicinity of a seat surface, thereby suppressing the variation in the stroke of the plunger due to the variation in the temperature of the plunger to a small value. In addition, the reason why the spherical surface is formed at the stopper which contacts the divergent portion of the guide pipe is because, when the valve is opened, the axial center of the ball valve is allowed to be coincident to that of the seat surface, thereby eliminating the irregular spray of the fuel and the irregular stroke of the plunger.

The seat surface of the fuel injection valve of the invention is not a mere conical seat, but a perpendicular seat which has small contacting surface with the ball, which contacting surface is formed in a conical surface at the corner of chamfering by approx. 0.1C, thereby enabling to suppress the variation in the flow rate of fuel due to the influence of the temperature of the fuel. Moreover, the outside of the conical surface of the guide pipe is sealed by brazing or soldering, thereby preventing the fuel from flowing from the divergent portion side to the coil side of the guide pipe and thus preventing in advance the fuel from being externally leaking. Further, it is noted that the fuel injection valve of the invention can be associated in a fuel supply control system of an internal combustion engine. More particularly, the fuel injection valve of the invention can be controlled by an electronic fuel controller which inputs parameters of the engine operation from sensors for detecting the rotating speed or frequency of the engine, intake manifold pressure, takeup air temperature, engine coolant temperature, etc.

Many other features, advantages and additional objects of the present invention will become manifest to those versed in the art upon making reference to the detailed description which follows and the accompanying sheet of drawings.

DETAILED DESCRIPTION OF THE PREFERRED EMBODIMENTS

The present invention will now be described in detail, with reference to embodiments illustrated in the accompanying drawings.

Figure 1:
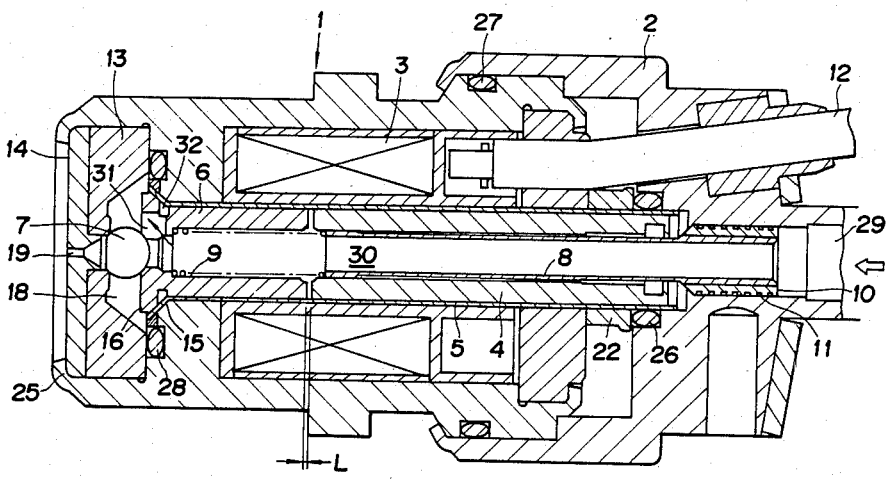
FIG. 1 is a sectional view showing an embodiment of an electromagnetic fuel injection valve according to the present invention.
Figure 2:
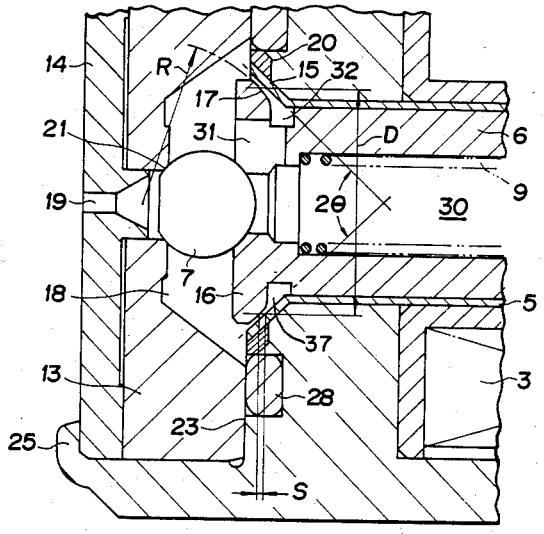
FIG. 2 is an enlarged sectional view showing the valve portion of the valve in FIG. 1.

FIG. 1 shows a sectional view of an electromagnetic fuel injection valve, and FIG. 2 shows an enlarged sectional view of the valve portion. Reference numeral 1 designates a cylindrical body made of a magnetic material, reference numeral 2 designates a top cover, reference numeral 3 designates a solenoid coil disposed in the body 1, reference numeral 4 designates a hollow stational core, reference numeral 5 designates a guide pipe made of a nonmagnetic material coated on the outer periphery of the core 4, reference numeral 6 designates a hollow plunger reciprocatingly telescoped in the guide pipe 5 oppositely to the core 4, reference numeral 7 designates a ball secured by resistance welding to the end of the plunger 6, reference numeral 8 designates an intermediate cylinder inserted into the core 4, reference numeral 9 designates a spring provided between the end of the cylinder 8 and the shoulder part in the plunger 6, and reference numeral 10 designates a stationary ring fusion-bonded to one end of the cylinder 8, which ring comprises annular grooves 11 of a plurality of rows formed on the outer peripheral surface thereof for partly intruding the inner wall of the top cover 2 when the top cover 2 is caulked from the side. Reference numeral 12 indicates a cable, reference numeral 13 indicates a seat member made of hardened steel, and reference numeral 14 indicates a nozzle plate.

Figure 4:
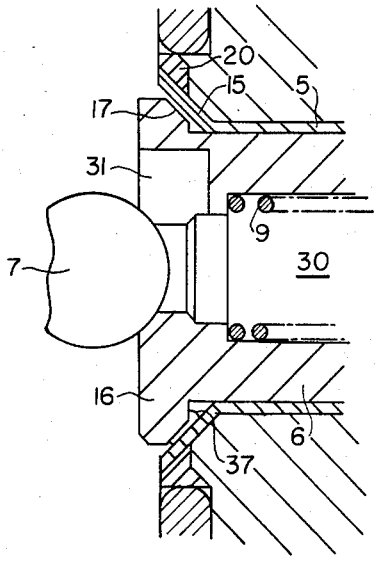
FIG. 4 is a view similar to FIG. 2 illustrating an alternate embodiment.

The guide pipe 5 is extended to a valve chamber (or a fuel chamber) 18 formed by a seat member 13, and the extended end is formed in a divergent conical surface 15 having a vertex 20 of a right angle as designated in an enlarged scale in FIG. 2. A collar-shaped stopper 16 is correspondingly formed at the side end of the valve chamber 18 of the plunger 6, and the inner corner, i.e., the side opposite to the ball is formed with a raised spherical surface 17 of radius R at the nozzle 19 side as a center. This spherical surface 17 makes contact, when the solenoid 3 is energized, with the conical surface 15 of the guide pipe 5, thereby performing the automatic centering operation at the suction stroke end of the plunger 6 in the guide pipe 5. When substantially central peripheral surface of the spherical surface 17 is represented by a stopper reference diameter D, the distance from the conical surface 15 from the reference diameter D becomes the stroke S of the plunger 6 in the guide pipe 5. As shown enlargedly in FIG. 2, a communication passage such as a groove or a hole 32 is formed at the stopper 16 at the opposite side to the ball 7 to communication with the fuel passage in the plunger 6. When the groove or hole 32 is not formed at the stopper 16 at the opposite side to the ball 7, the spherical surface is formed from the upper end of the stopper 16 at the opposite side to the ball 7 to the vicinity of the cylindrical surface of the plunger 6, and, as shown in FIG. 4 which corresponds to FIG. 2 with the groove or hole 32 removed, an annular space 37 of triangular section should be accordingly produced at the associating time of the fuel injection valve. When the spherical surface 17 is separated from the conical surface 15 at the time of operating the plunger 6, the pressure in the space A becomes lower, the spherical surface 17 is adsorbed to the conical surface 15, thereby disturbing the separation of the spherical surface 17 from the conical surface 15.

Therefore, according to the present invention, the passage 32 is formed at the stopper 16 at the opposite side to the ball 7 as shown in FIG. 2, fuel passage 30 or 31 in the plunger 6 is communicated with the space 37, thereby decreasing the pressure at the opposite side to the ball 7, eliminating the adsorbing phenomenon of the spherical surface 17 to the conical surface 15 and securing the smooth reciprocations of the plunger 6. It is noted that, in the exemplified embodiment, the conical surface is formed at the end of the guide pipe. However, a raised spherical surface may be formed at the end of the guide pipe.

The back surface side of the conical surface 15 is sealed at 20 by brazing or soldering to the wall surface of the body 1, thereby preventing the fuel from entering from the enlarged diameter side of the guide pipe 5 to the coil side. The seat surface 21 of the seat member 13 is formed perpendicularly, and the contacting part of the ball 7 with the seat surface 21 of the seat member 13 has a conical surface at 0.1C cut by 0.1 mm at the corner of a right angle.

DESCRIPTION OF ASSOCIATING FUEL INJECTION VALVE

The other end of the guide pipe 5 is outwardly protruded from the body 1 as shown in FIG. 1, and a fixing ring 22 is engaged at the other end of the guide pipe 5. Before the top cover 2 is associated, one or more adjusting shims (not shown) are inserted between the end of the core 4 and the rear end of the plunger 6 to set an air gap L (e.g., 30 to 40 microns). Then, the guide pipe 5 is spot welded from the outside at the position to be engaged, thereby integrating the guide pipe 5 with the core 4 to fix the positional relationship between the guide pipe 5 and the core 4. After the ring 22 is then engaged with the position to be spot welded, the top cover 2 is covered. Thus, it is ready to set by spot welding the air gap to fix the core 4 to the guide pipe 5.

The stroke S is then adjusted by first removing the shims, sequentially associating the plunger 6 fixed with the ball 7, the seat member 13 and the nozzle plate 14 at the body side, and fundamentally positioning them at the contacting surface 23 of the nozzle plate 14 with the body 1. Then, the nozzle plate 14 is pressed to the body side while confirming the fact that the interval between the spherical surface 17 of the plunger 6 and the conical surface 15 of the guide pipe 5 becomes a predetermined size on the reference diameter D via the flow rate of fuel. Thus, since the body 1 made of the magnetic material is softer than the seat member 13, the contacting surface 23 is deformed, the nozzle plate 14 is intimately contacted with the body 1, thereby fixing the nozzle plate 14 at the position of specified flow rate of fuel and thus completing the adjustment of the stroke S. After the adjustment of the stroke S, the front edge 25 of the body 1 is bent to cover the peripheral edge of the nozzle plate 14 as shown, and caulked to complete the entire assembly. Further, O-rings 26, 27 of elastic material are inserted as shown at the engaging portion of the body with the top cover 2, and a similar O-rings 28 is disposed between the front side of the body 1 and the seat member 13.

OPERATION OF FUEL INJECTION VALVE

Fuel is fed from an inlet 29 formed at the center of the top cover 2 through the intermediate cylinder 8 and the fuel passage 30 in the plunger 6 and through the fuel passage 31 formed by the notch at the end of the plunger 6 into the valve chamber (or fuel chamber) 18. In the state shown in FIGS. 1 and 2, the solenoid coil 3 is not energized, the ball 7 is contacted under pressure with the seat surface 21 by the tension of the spring 9, thereby closing the valve to stop ejecting of the fuel.

When the solenoid coil 3 is energized, the plunger 6 moves rightwardly in the drawing against the tension of the spring 9, and the spherical surface 17 of the stopper 16 makes contact with the conical surface 15 of the guide pipe 5 and resultantly stops. When the plunger 6 thus moves rightwardly, the ball 7 is simultaneously separated from the seat surface 21, and fuel is ejected through the gap from the nozzle 19 in a predetermined quantity. Subsequently, the solenoid coil 3 is deenergized, the ball 7 is contacted with the seat surface 21, thereby stopping ejecting of the fuel. In this case, since the plunger 6 at the opposite side to the ball 7 is communicated with the fuel passage 31 or 30 in the plunger 6, the opposite side to the ball 7 does not become low pressure, with the result that the plunger 6 can smoothly move. The above operation of the fuel injection valve is repeated to eject the fuel of a predetermined quantity.

The flow rate of the ejected fuel depends upon the area of the opening of the nozzle 19, the annular area fored of the ball 7 and the seat surface 21, and the opening time. Since the plunger 6 should slide in the guide pipe 5, a predetermined clearance between the plunger 6 and the guide pipe 5 is necessary therebetween. Thus, the reciprocation of the plunger 6 causes a slight displacement from an axial center. In addition, it is not always possible that the magnetic path of the plunger in section becomes uniform magnetic flux density. In view of this fact, the plunger 6 cannot avoid the displacement from the axial center in the guide pipe. However, as described above, the plunger 6 has the raised spherical surface 17 at the inside corner of the stopper 16, the spherical surface 17 of the plunger 6 is contacted with the conical surface 15 of the guide pipe 5, and an automatic centering operation is consequently performed at the suction stroke end of the plunger 6. Since the automatic centering operation of the plunger 6 is thus achieved, the ball 7 and the seat surface 21 is always concentrically disposed when the plunger 6 is moved toward the valve closing direction, thereby breaking the current of the coil 3. Thus, even if the plunger 6 is displaced in the valve closing direction by the tension of the spring 9, the above-described automatic centering operation is maintained, thereby preventing the irregular wear and external leakage of fuel due to the displacement of the plunger 6 from the axial center.

Since a conventional ball valve seats a long conical portion on a ball, the flow rate of fuel alters due to the variation in the viscosity of fuel caused by the temperature of the fuel flowing at the conical portion. However, according to the present invention, since the seat surface 21 is formed in a conical surface (at approx. 0.1C) of substantially right angle at the vertex, the adverse influence of the temperature of the fuel to the fuel flow rate is very small which can be substantially ignored.

Figure 3:
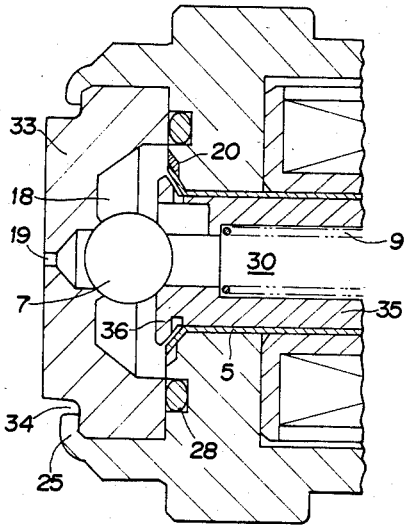
FIG. 3 is a partially enlarged sectional view of a modified embodiment of the fuel injection valve of the invention.

FIG. 3 shows another embodiment of a fuel injection valve according to the present invention. In this embodiment, the nozzle plate in the fuel injection valve shown in FIGS. 1 and 2 is omitted, a seat member 33 is formed slightly thickly, an annular stepped part 34 is formed on the outer surface and the front edge 25 of the body 1 is caulked.

In this embodiment, a conical surface is formed at the end of the guide pipe 5, and a spherical surface is formed at the stopper. Thus, an automatic centering operation is performed at the stroke end of the plunger 5, and when the valve is closed, the ball and the nozzle are always concentrically disposed, and irregular wear and fuel leakage due to the displacement of the plunger from the axial center can be prevented at the time of sliding the plunger.

What is claimed is:

1. An electromagnetic fuel injection valve having a body of magnetic material, a core and a hollow plunger disposed in the body and formed with a fuel passage communicating with a valve chamber, a ball valve secured to the end of the plunger and separably associated with a seat member, and a solenoid coil for opening the ball valve upon energization thereof to eject fuel comprising:

a guide pipe surrounded on the outer periphery of said core and extended at the end thereof to said valve chamber, and a stopper formed between the extended end of said guide pipe and the protruded end of said plunger at the valve chamber side engaged within said guide pipe for restricting the stroke of said plunger.

2. The electromagnetic fuel injection valve according to claim 1, wherein said guide pipe is formed with a divergent conical or spherical surface at the extended end thereof at said valve chamber side, and said stopper of the plunger is formed with a spherical surface in contact with the conical or spherical surface of said guide pipe in an automatic centering manner at the suction stroke end of said plunger.

3. The electromagnetic fuel injection valve according to claim 1, wherein the seat surface of said seat member comprises a right angle and the contacting portion thereof with a ball is formed with a conical surface substantially at 0.1C.

4. The electromagnetic fuel injection valve according to claim 1, wherein said core is set with an air gap from the upstream side of said plunger, and is spot welded to said guide pipe.

5. The electromagnetic fuel injection valve according to claim 2, wherein the conical or spherical surface of said guide pipe is secured to perform a sealing function by brazing or soldering between the inner wall of said body and the the outside of the conical or spherical surface of said guide pipe for preventing fuel leakage from the outside end thereof to the coil side.

6. A fuel injection valve having a body of magnetic material, a core and a hollow plunger disposed in the body and formed with a fuel passage communicating with a valve chamber, a ball valve secured to the end of the plunger and separably associated with a seat member, and a solenoid coil for opening the ball valve upon energization thereof to eject fuel comprising:

a guide pipe surrounded on the outer periphery of said core, said guide pipe extended at the end of said guide pipe to said valve chamber, a conical surface formed at the extended end of the valve chamber of said guide pipe in an increased diameter toward said valve chamber side, a plunger engaged to reciprocatingly telescope in said guide pipe by the actuation of said solenoid coil, a stopper formed at the end of said plunger, said stopper formed in a spherical surface at the opposite side to a ball in contact with said conical surface at the suction stroke end of said plunger, and a communication passage formed at the root of said stopper at the opposite side to the ball to communicate the opposite side to the ball with the fuel passage.

7. The electromagnetic fuel injection valve according to claim 6, wherein the seat surface of said seat member comprises a right angle and the chamfered contacting portion thereof with a ball is formed with a conical surface substantially at 0.1C.

8. The electromagnetic fuel injection valve according to claim 6, wherein said core is set with an air gap from the upstream side of said plunger, and is spot welded to said guide pipe.

9. The electromagnetic fuel injection valve according to claim 6, wherein the conical or spherical surface of said guide pipe is secured to perform a sealing function by brazing or soldering between the inner wall of said body and the the outside of the conical or spherical surface of said guide pipe for preventing fuel leakage from the outside end thereof to the coil side.

* * * * *

UNITED STATES PATENT AND TRADEMARK OFFICE

CERTIFICATE OF CORRECTION

PATENT NO. : 4,552,312

DATED : November 12, 1985

INVENTOR(S) : Yasuo Ohno et al

It is certified that error appears in the above-identified patent and that said Letters Patent is hereby corrected as shown below:

Col. 4, line 45, delete "O-ring" and substitute therefore ---o-ring---; Col. 6, line 29, after "and" delete" the"; Col. 6, line 65, after "and" delete "the"

Signed and Sealed this

*Twenty-ninth* Day of *April 1986*

[SEAL]

*Attest:*

DONALD J. QUIGG

*Attesting Officer*

*Commissioner of Patents and Trademarks*